US008833596B2

(12) United States Patent
Sanguinet et al.

(10) Patent No.: US 8,833,596 B2
(45) Date of Patent: Sep. 16, 2014

(54) MOUNTING BRACKET FOR A CONTAINER

(75) Inventors: Andrew Sanguinet, Oak Park, IL (US); Brett Niggel, Corry, PA (US); Steven Kroplewski, Roselle, IL (US); Scott Jost, Glen Ellyn, IL (US)

(73) Assignee: Berlin Packaging, LLC, Chicago, IL (US)

( * ) Notice: Subject to any disclaimer, the term of this patent is extended or adjusted under 35 U.S.C. 154(b) by 64 days.

(21) Appl. No.: 13/614,175

(22) Filed: Sep. 13, 2012

(65) Prior Publication Data

US 2014/0069939 A1 Mar. 13, 2014

(51) Int. Cl.
*B65D 1/42* (2006.01)

(52) U.S. Cl.
USPC ..... 220/647; 220/646; 220/699; 220/480; 220/476; 211/87.01; 211/86.01; 211/75; 211/74; 211/71.01; 248/316.7; 248/311.2

(58) Field of Classification Search
CPC ..... F16M 11/041; F16M 11/04; F16M 11/10; F16M 11/16; F16M 13/00; F16M 13/02; F16M 2200/024; A01K 1/0356; A01K 1/0114; A01K 5/0114; A01K 7/02; A01K 7/06; A01K 97/04; B65D 23/003; B65D 25/22; B65D 47/0847; B65D 83/267; B65D 83/386; B65D 85/24
USPC ..... 211/75, 86.01, 87.01, 71.01; 220/476–477, 646–647, 694, 699, 220/480–481; 248/311.2, 314, 477.2, 248/316.7; 215/395; 224/191, 247, 224/676–677
See application file for complete search history.

(56) References Cited

U.S. PATENT DOCUMENTS

| | | | | | |
|---|---|---|---|---|---|
| 1,794,700 | A | * | 3/1931 | McCaskey | 248/224.51 |
| 2,427,335 | A | * | 9/1947 | Antonia et al. | 248/223.41 |
| 2,605,021 | A | * | 7/1952 | Churchill et al. | 222/153.03 |
| 2,754,991 | A | * | 7/1956 | Hagerty et al. | 220/481 |
| 3,212,660 | A | * | 10/1965 | Adell | 248/313 |
| 3,224,644 | A | * | 12/1965 | Davis | 222/162 |
| 4,088,250 | A | * | 5/1978 | Schaefer | 215/395 |
| 4,579,309 | A | * | 4/1986 | Fujiwara et al. | 248/311.2 |
| 4,679,709 | A | * | 7/1987 | Poitras et al. | 222/180 |
| 5,145,139 | A | * | 9/1992 | Holtsch | 248/313 |
| 5,226,625 | A | * | 7/1993 | Hanna | 248/222.13 |
| 5,326,006 | A | * | 7/1994 | Giard, Jr. | 224/414 |
| 5,356,105 | A | * | 10/1994 | Andrews | 248/221.11 |
| 5,406,816 | A | * | 4/1995 | Thomas | 62/457.1 |
| 5,480,115 | A | * | 1/1996 | Haltof | 248/221.11 |
| 5,492,238 | A | * | 2/1996 | Scholl et al. | 220/263 |

(Continued)

*Primary Examiner* — Mickey Yu
*Assistant Examiner* — Brijesh V. Patel
(74) *Attorney, Agent, or Firm* — Adam K. Sacharoff; Much Shelist

(57) ABSTRACT

In one embodiment there is provided a mounting bracket for use with a container. The container has a wall extending from a bottom to an upper edge and has a mounting flange extending outwardly from a portion of the wall. The mounting flange includes an outer surface with a terminal edge leading to upper and lower edges and a pair of distal sides. The mounting bracket has a support side positionable towards the wall of the container. The support side includes a notched section with a base extending outwardly from the support side and a pair of lateral faces extending outwardly and away from edges of the base. Each lateral face includes a member positioned along a portion thereof and which extends towards the other member in a tapering edge such that the sides of the mounting flange are captured between the support side and the extending members.

7 Claims, 7 Drawing Sheets

(56) References Cited

U.S. PATENT DOCUMENTS

| | | | | |
|---|---|---|---|---|
| 5,494,250 | A * | 2/1996 | Chen | 248/316.7 |
| 5,549,074 | A * | 8/1996 | Hui | 119/477 |
| 5,669,329 | A * | 9/1997 | Krause | 119/72.5 |
| D394,933 | S * | 6/1998 | Studer | D34/6 |
| 5,813,644 | A * | 9/1998 | Bergin | 248/311.2 |
| 5,934,222 | A * | 8/1999 | Hwang | 119/72 |
| 5,947,322 | A * | 9/1999 | Ho | 220/477 |
| 5,992,698 | A * | 11/1999 | Copeland et al. | 222/180 |
| 6,095,470 | A * | 8/2000 | Kalis | 248/309.1 |
| 6,318,687 | B2 * | 11/2001 | Trana et al. | 248/220.21 |
| 6,321,943 | B1 * | 11/2001 | Strickler et al. | 222/82 |
| 6,427,958 | B1 * | 8/2002 | Looney | 248/220.21 |
| 6,557,206 | B1 * | 5/2003 | Liu | 15/327.5 |
| 6,572,063 | B1 * | 6/2003 | Gitelman et al. | 248/314 |
| 6,983,918 | B1 * | 1/2006 | Leasure | 248/311.2 |
| 7,234,673 | B2 * | 6/2007 | Graneto, III | 248/311.2 |
| 2005/0077385 | A1 * | 4/2005 | Chen | 239/302 |
| 2005/0178941 | A1 * | 8/2005 | Burns et al. | 248/475.1 |
| 2005/0224539 | A1 * | 10/2005 | Hardy et al. | 224/274 |
| 2006/0081749 | A1 * | 4/2006 | Sherman et al. | 248/309.1 |
| 2006/0086876 | A1 * | 4/2006 | Heerdt et al. | 248/311.2 |
| 2006/0231717 | A1 * | 10/2006 | Coren | 248/311.2 |
| 2007/0045492 | A1 * | 3/2007 | Moran | 248/222.11 |
| 2007/0108213 | A1 * | 5/2007 | Schmidt | 220/476 |
| 2008/0142674 | A1 * | 6/2008 | Dang et al. | 248/674 |
| 2008/0283556 | A1 * | 11/2008 | Snodgrass | 222/325 |
| 2010/0176261 | A1 * | 7/2010 | Chen et al. | 248/231.91 |

* cited by examiner 200
272
280
270
260
250
275
205
255
264
262
232
215
225
230
230
235
220
290
237
240
237
240
290

MOUNTING BRACKET FOR A CONTAINER

FIELD OF THE INVENTION

The present invention relates to a mounting bracket used with a container to allow a container to be mounting to a wall.

BACKGROUND OF THE INVENTION

It has become popular to employ various types of disposable items in containers for various industries and in everyday life. These disposable items can be dry or moist paper towels, towelettes, napkins, or other items used for cleaner or as a treatment. These containers are typically stored under cabinets or on top of a counter. In any event, it is always beneficial to have the containers within reach of the user and more desirable if the container was not on the counter. For example, if the container is resting on the counter and the counter needs to be cleaned, the container must always be moved around; similarly, if a spill occurs on the counter then the container may continuously need to be cleaned. There is therefore a need to have the container within reach of a user but not necessarily under a cabinets or on top of a counter. The present invention solves the current need by providing an easy mounting bracket that can be used with a container to mount the container to a wall or surface.

SUMMARY OF THE INVENTION

In one embodiment of the present invention there is provided a mounting bracket for use in combination with a container. The combination includes a container having a continuous wall extending from a bottom to an upper edge, and further having a mounting flange extending outwardly from a portion of the continuous wall. The mounting flange includes an outer surface with a terminal edge leading to an upper edge, lower edge and a pair of distal sides. The mounting bracket has a support side positionable towards the continuous wall of the container. The support side includes a notched section with a base extending outwardly from the support side and a pair of lateral faces extending outwardly from the support side and extending away from edges of the base. Each lateral face includes a member positioned along a portion thereof and which extends towards the other member in a tapering edge such that the sides of the mounting flange are captured between the support side and the extending members.

In addition, the mounting bracket may further include a locking wedge positioned on the support side and having a lower edge to secure against the upper side of the mounting flange when the container is positioned within the mounting bracket. The locking wedge may also include a tapered edge extending from the support side to a terminus defined by the lower edge of the locking wedge.

The mounting bracket may also include a slot extending from one side of the mounting bracket towards the other side of the mounting bracket, the slot creating an arm between an upper edge of the mounting bracket and the slot such that the arm is moveable away from the container when a force is applied against the arm thereby moving the locking wedge to a position that the lower edge disengages against the upper side of the mounting flange. In addition, a plate may extending outwardly from an edge of the arm to provide support for a user bending the arm.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
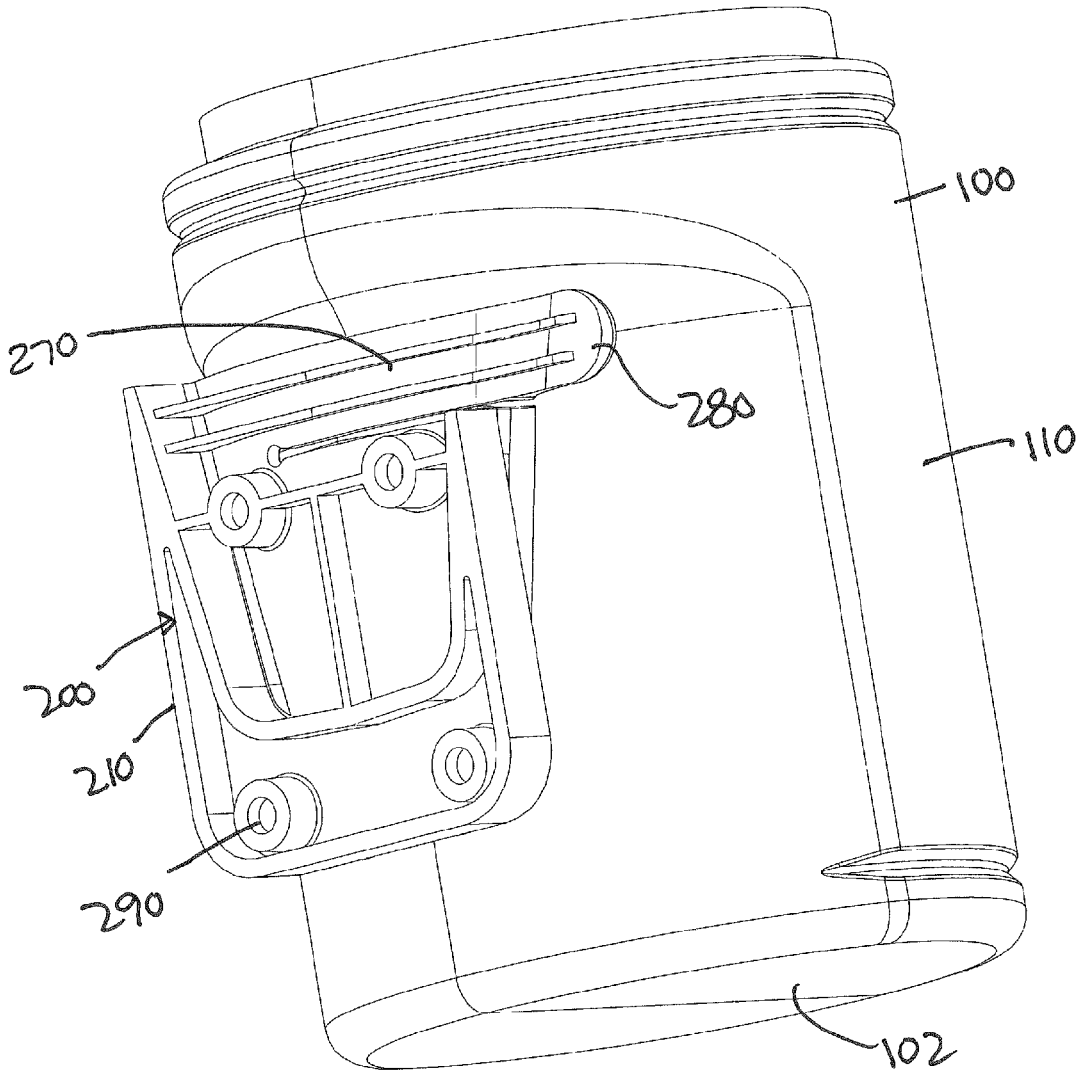
FIG. 1 is a perspective view of a combination container with mounting bracket in accordance with one embodiment of the present invention.
Figure 2:
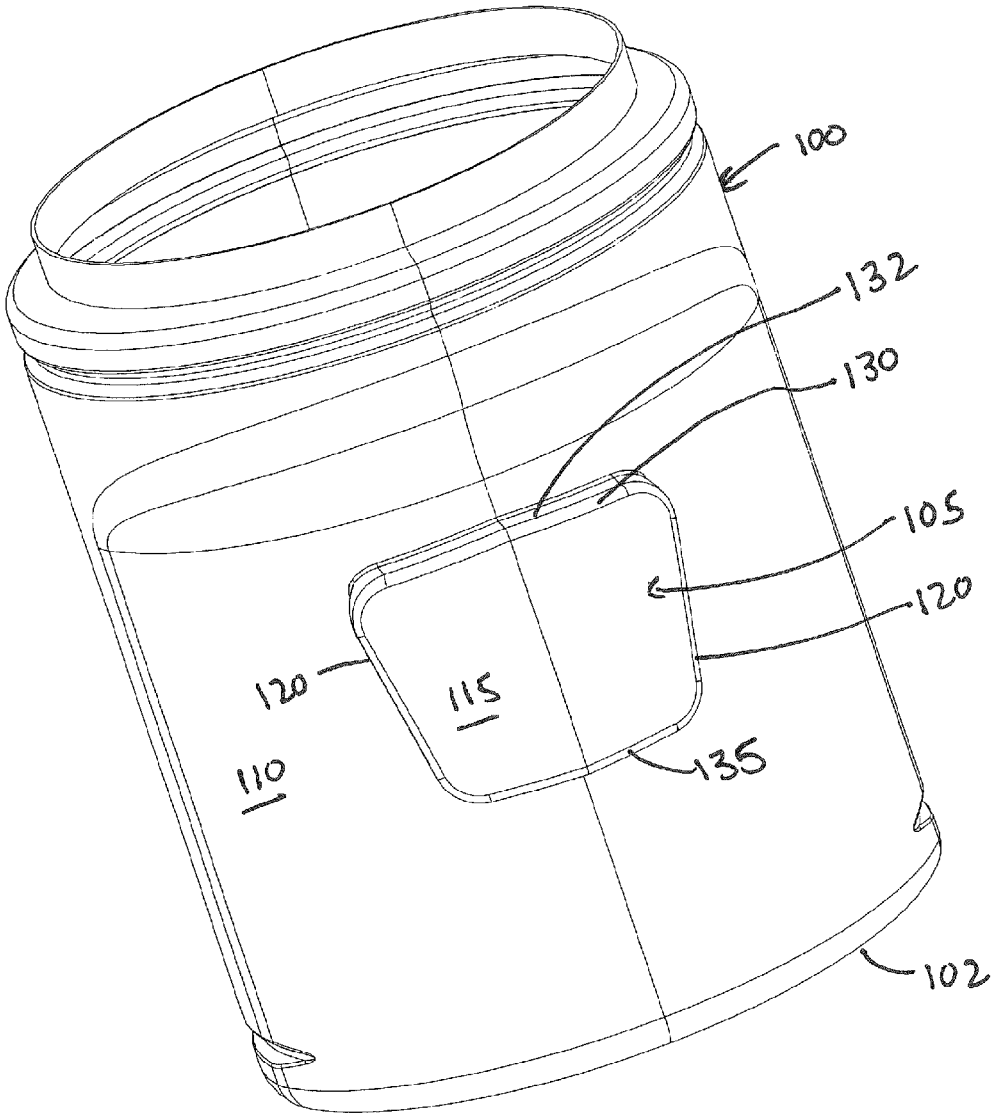
FIG. 2 is a perspective view of the container from FIG. 1.
Figure 3:
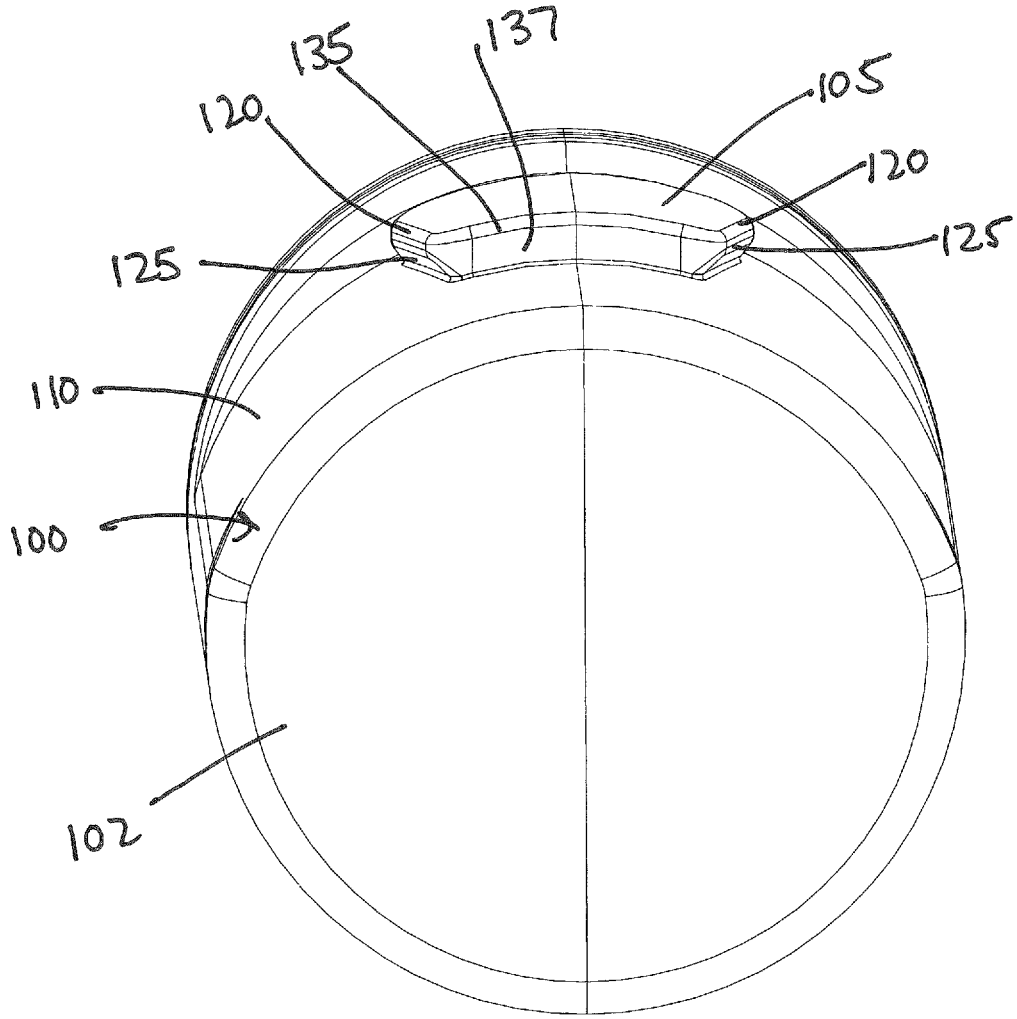
FIG. 3 is a bottom perspective view of the container from FIG. 1.
Figure 4:
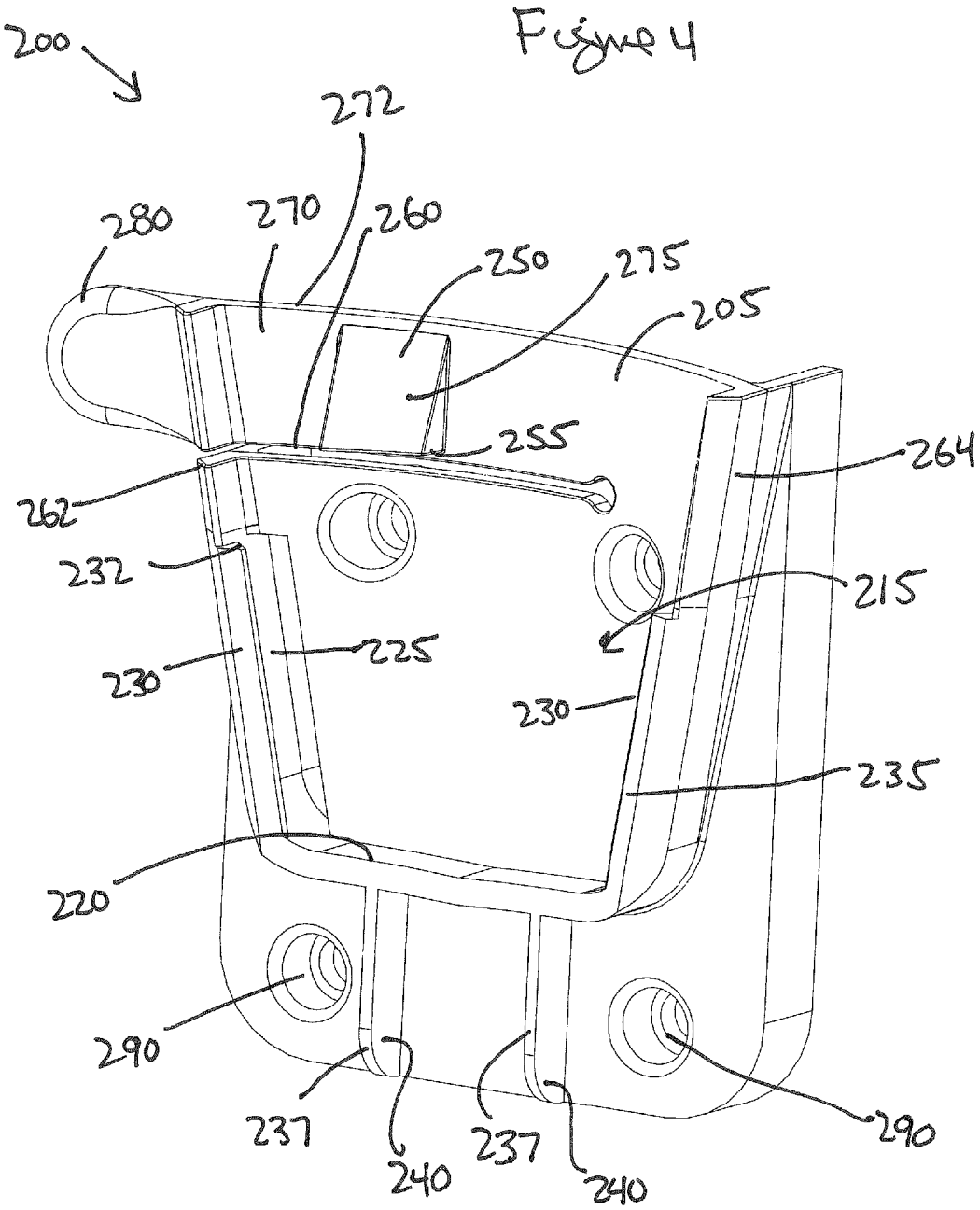
FIG. 4 is an interior perspective view of the mounting bracket from FIG. 1.
Figure 5:
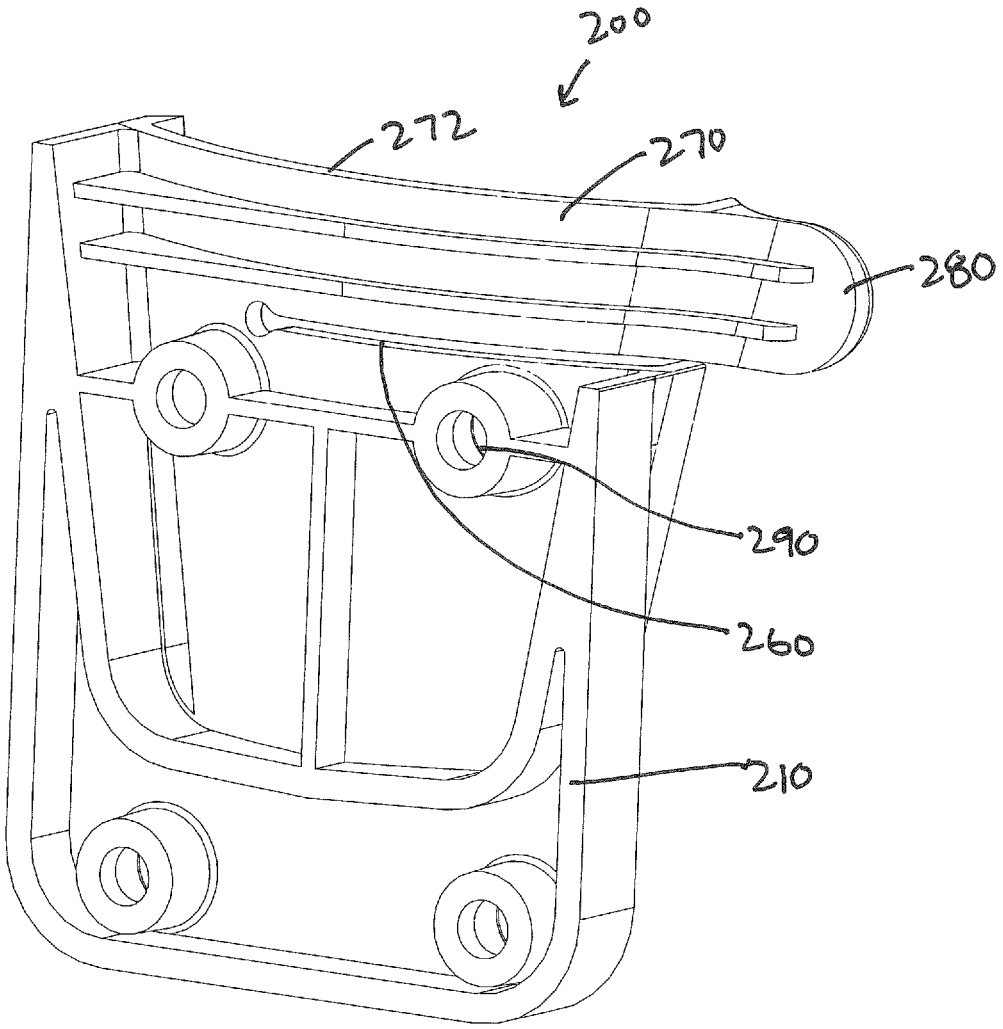
FIG. 5 is an exterior perspective view of the mounting bracket from FIG. 1.
Figure 6:
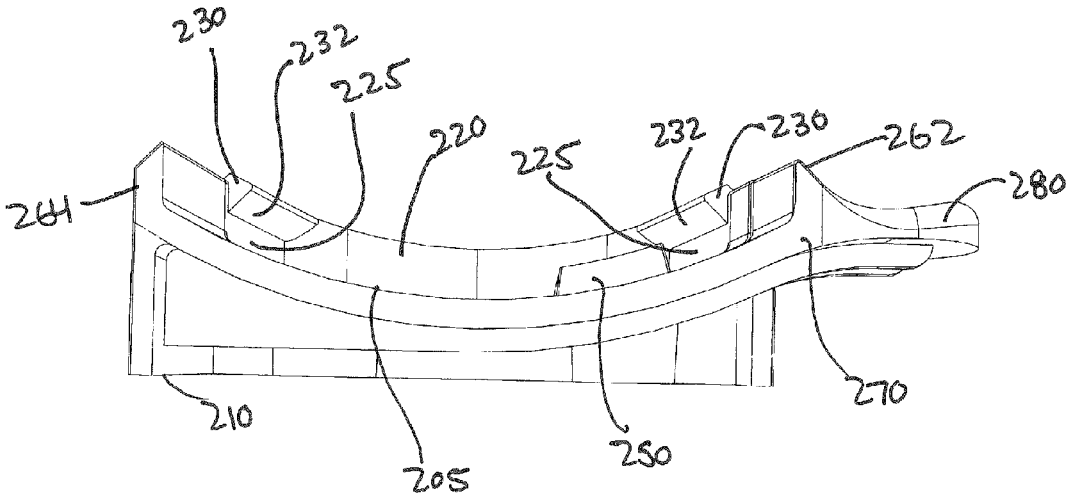
FIG. 6 is a top view of the mounting bracket from FIGS. 1.
Figure 7:
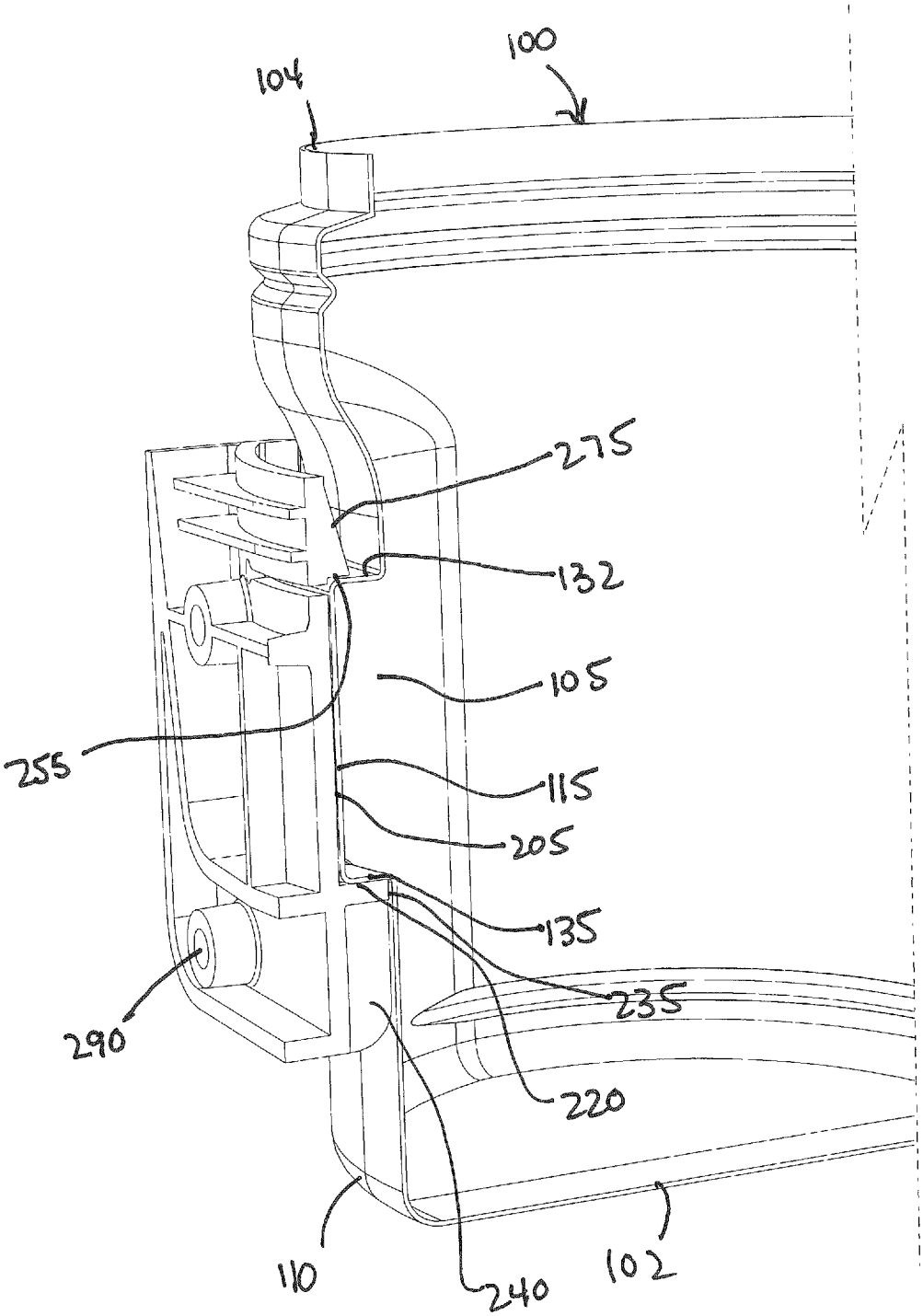
FIG. 7 is a cross section view of the mounting bracket and container.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, there is provided a container 100 and a mounting bracket 200 used in combination therewith to mount the container to a wall or surface. The container 100 includes a bottom 102 and a continuous wall 110 extending upwardly therefrom. The wall 110 extends from the terminus edge of the bottom 102 and extends upwardly to a top edge 104. A suitable cover or top can be provided to help seal the container when not in use.

The container 100 further includes a mounting flange 105 extending from a portion of the continuous wall 110 of the container 100. The mounting flange 105 includes an outer surface 115 having a pair of edges 120, which terminate to the sides 125 of the mounting flange. The sides taper inwardly towards the continuous wall 110 of the container 100. The mounting flange 105 further includes an upper mounting flange edge 130 and lower mounting flange edge 135 that terminate to upper and lower distal sides 132 and 137, respectively.

The mounting bracket 200 includes a support side 205 and an outside side 210. The support side 205 would be positioned towards the continuous wall 110 of the container 100, while the outside side 210 would face away from the continuous wall 110 of the container 100.

The support side 205 includes a notched section 215 defined to have a base 220 extending outwardly from the support side 205 and a pair of lateral faces 225 extending outwardly from the support side 205 and extending away from distal edges 222 of the base. The lateral faces 225 also taper outwardly away from the base 220 to conform to the pair of edges 120 of the mounting flange 105. Each lateral face 225 further includes a inwardly turned member 230 positioned along a portion thereof and which extends towards the other inwardly turned ember 230 in a tapering edge 232 such that the sides 125 of the mounting flange are captured between the support side 205 and the inwardly turned members 230. The inwardly turned members 230 and the base 220 include an exterior edge 235 that abuts the continuous wall 110 when the container 100 is secured to the mounting bracket 200. For additional support one or more brace members 240 may extend from the support side 205 and which include exterior edges 237 that would abut the continuous wall 110 when the container is secured to the mounting bracket 200.

To further help secure the container 100 to the mounting bracket 200, the mounting bracket 200 may include a locking wedge 250. The locking wedge 250 includes an lower edge 255 that secures against the upper side 132 of the mounting flange 105. The locking wedge 250 is positioned on the support side 205 above a grooved slot 260 that extends from one side 262 of the mounting bracket 200 towards the other side 264 and more preferably extends through at least half of the support side 205. The grooved slot 260 creates an arm 270 above the grooved slot and below the upper edge 272 of the mounting bracket. The arm is therefore moveable when a user applies a force that bends the arm away from a container mounted to the mounting bracket. When moved a certain distance the locking wedge 250 is pulled away such that the lower edge 255 is not abutting the upper side 132 of the mounting flange 105, which allows the user to slide the container out of engagement with the mounting bracket 200.

The locking wedge 250 may further include a tapered edge 275 extending from the support side 205 to the terminus 257 of the lower edge 255. The tapered edge 275 allows a user to slide the container into place without also having to bend the arm 270. As the container slides down the tapered edge 275, pressure is automatically placed against the tapered edge to move the arm 270 and allow the container to continue to slide into place. In addition, a finger plate 280 may be including and extending outwardly from an edge of the arm 270. The finger plate 280 provides a user an area to grasp when pulling the arm away from the container.

Lastly, fastening openings 290 may be positioned through the mounting bracket 200 to allow a user to secure the mounting bracket 200 to a surface or wall.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A mounting bracket for use in combination with a container, the combination comprising:

a container having a continuous wall extending from a bottom to an upper edge, and further having a mounting flange extending outwardly from a portion of the continuous wall, the mounting flange including an outer surface, and further including an upper edge, lower edge and a pair of distal sides; and a mounting bracket having a support side adapted to be positioned towards the continuous wall of the container, the support side including a notched section configured to capture the container therein, the notched section is defined by having a base extending outwardly from the support side and a pair of lateral faces extending away from side edges defined by the base and extending along the support side upwardly away from the base, each lateral face includes an inwardly turned member positioned along a portion thereof and which extends towards the other member such that the notched section is configured to receive the distal sides of the mounting flange between the support side of the mounting bracket and the inwardly turned members, and wherein the mounting bracket further includes a locking wedge positioned on the support side, the locking wedge having a lower locking edge configured to engage and secure against the upper edge of the mounting flange when the container is positioned within the mounting bracket thereby locking the container within the mounting bracket, and wherein the mounting bracket further includes a slot extending from one of the distal sides of the mounting bracket towards the other distal side of the mounting bracket creating an arm portion, the slot is further defined at a position adjacent the lower locking edge such that the locking wedge is located on the arm portion, the slot is configured to allow the arm portion to move away from the container when a force is applied against the arm portion, wherein movement of the arm portion is further configured to cause the locking wedge to move and the lower locking edge to disengage against the upper side of the mounting flange allowing the container to be removed from the mounting bracket.

2. The combination of claim 1, wherein the locking wedge further includes a tapered edge extending from the support side to a terminus defined by the lower locking edge of the locking wedge.

3. The combination of claim 1, wherein the arm portion of the mounting bracket further includes a plate extending outwardly from an edge of the arm portion.

4. The combination of claim 1, wherein the distal sides of the mounting flange taper inwardly towards the continuous wall of the container and wherein the lateral faces further taper outwardly away from the base to conform to the tapering of the distal sides of the mounting flange.

5. The combination of claim 1, wherein the mounting bracket further having an outside side mountable against a surface or wall.

6. The combination of claim 1, wherein the inwardly turned members and the base include a flat exterior edge that abuts the continuous wall when the container is secured to the mounting bracket.

7. The combination of claim 1, wherein the mounting bracket further includes one or more brace members extending from the support side and which include exterior edges to abut the continuous wall when the container is secured to the mounting bracket.

* * * * *